US005595327A

United States Patent [19]

Dentler et al.

[11] Patent Number: 5,595,327

[45] Date of Patent: Jan. 21, 1997

[54] CAULK GUN WITH TUBE ENGAGING RECEPTACLE

[75] Inventors: Christopher G. Dentler; John N. Zagone, both of Portland, Oreg.

[73] Assignee: Z-Pro International, Inc., Portland, Oreg.

[21] Appl. No.: 330,536

[22] Filed: Oct. 27, 1994

Related U.S. Application Data

[63] Continuation-in-part of Ser. No. 269,063, Jun. 30, 1994, Pat. No. 5,553,754.

[51] Int. Cl.[6] ..... B65D 88/54

[52] U.S. Cl. ..... 222/327; 222/391

[58] Field of Search ..... 222/327, 391

[56] References Cited

U.S. PATENT DOCUMENTS

| | | | |
|---|---|---|---|
| 4,090,639 | 5/1978 | Campbell et al. | 222/391 |
| 4,318,499 | 3/1982 | Hamilton | 222/327 |

*Primary Examiner*—Gregory L. Huson
*Attorney, Agent, or Firm*—Klarquist Sparkman Campbell Leigh & Whinston, LLP

[57] ABSTRACT

A caulk gun having a piston with a flexible rim providing dripless dispensing of caulk or adhesive and including a tube-engaging receptacle for securely holding a tube is disclosed. The advantages of a dripless caulk gun are provided by a piston having a flexible circumferential rim that engages an inside surface of a caulk or adhesive dispensing tube to create an atmospheric seal. The plunger moves the piston against an inside movable surface of the dispensing tube. When the trigger is released, the plunger mechanism moves backward, and the piston creates a partial vacuum within the caulk tube thereby halting dispensing. The dispensing tube is attached to the caulk gun by secure engagement with a tube-engaging receptacle. The receptacle may be provided with threads that threadingly engage with a portion of the dispensing tube. Alternatively, the tube-engaging receptacle may be provided with threads and a threaded lockring wherein the lockring fits down over the caulk tube and presses against a protruding band. Also disclosed is a piston for providing dripless operation wherein the piston comprises a disc and gasket that can be attached to prior art plunger assemblies.

22 Claims, 4 Drawing Sheets

CAULK GUN WITH TUBE ENGAGING RECEPTACLE

CROSS REFERENCE TO RELATED APPLICATIONS

This application is a continuation-in-part of patent application Ser. No. 08/269,063, filed Jun. 30, 1994 now U.S. Pat. No. 5,553,754.

BACKGROUND OF THE INVENTION

1. Field of the Invention

This invention relates to the field of dripless caulk guns, and to caulk guns having no barrel for supporting the caulk tube.

2. Description of Related Art

Caulk guns are used for dispensing and applying caulk and adhesive. Caulk is used by building contractors and homeowners for sealing windows and doors, particularly as a means of weatherproofing. Adhesive is used by craftspersons for adhering materials, typically wood. One industry convention for dispensing caulk and adhesive comprises a caulk gun in combination with a plastic or cardboard cylindrical canister or tube which is filled with caulk or adhesive. One end of the canister is provided with a nipple or nozzle for dispensing the caulk. Another end of the canister is provided with a drive plate (a movable end plate within the caulk tube) that rides along an interior surface of the canister and pushes against the caulk or adhesive so as to dispense it through the nipple. Hereinafter, reference will be made to caulk and caulk tubes, but it should be noted that the reference is intended to encompass both caulk and adhesives.

Prior art caulk guns provide a body that supports the caulk canister, a trigger and a plunger mechanism including a piston. Some caulk guns provide a ratchet and pawl arrangement wherein the trigger may be squeezed to advance the plunger and, as the trigger is released, the pawl clicks backward along one or more notches in the plunger so that when the trigger is squeezed again it advances the plunger from its previous position. With the ratchet and pawl engaged, the plunger is not free to move backwards. To release the plunger and move it back from the canister, the plunger must be rotated so as to disengage the pawl from the notches in the plunger, thereby permitting the plunger to move freely backwards.

Another type of caulk gun, referred to herein as a biasspring drive system, is shown in Chang, U.S. Pat. No. 4,081,112. Chang discloses a biased "plunger drive grip" that grabs a plunger rod when it is canted by a trigger. Further motion of the trigger moves the drive grip and plunger against the caulk gun for dispensing caulk. A second trigger releases the drive grip so the plunger can move back to take pressure off the caulk tube to prevent continued dripping of caulk. Thus, the caulk gun of Chang would drip excess caulk until the second trigger is operated. However, even after the second trigger is actuated, some caulk will drip from the caulk gun because the drive plate in the caulk tube will maintain some pressure against the caulk in the canister, which pressure will be proportional to the frictional resistance of the drive plate against the interior walls of the caulk canister.

Prior art caulk guns included the aforementioned body that receives and supports the caulk canister. The body generally comprises a frame or cut-away barrel that extends from a proximal end near the trigger to a distal end. Frames generally comprise two or more stringers that extend from a stationary back plate connected to the handle and trigger assembly up to a cup-shaped front plate with a U-shaped cutout for the nozzle. In the case of the barrel shaped body, the barrel comprises an open semi-tube that receives and cradles the caulk canister between a back plate and a cup-shaped front plate. Generally, the back plate is recessed to receive a back end of the caulk canister while the canister's front end is dropped into position.

Several problems with prior art caulk guns are readily apparent to those skilled in the art. First, most prior art caulk guns operate by pushing a plunger against a drive plate inside the caulk tube thereby building up pressure within the caulk tube itself. Even after the trigger mechanism has been released, the caulk tube continues to slowly dispense caulk through the nozzle because of internal pressure in the caulk tube. Attempts to provide dripless caulk guns have achieved only partial success because all prior art attempts merely relieved the pressure of the plunger mechanism against the drive plate of the caulk tube. None of the prior art caulk guns provide any way of relieving the pressure of the drive plate against the caulk in the caulk tube.

Furthermore, prior art systems for holding the caulk tube in the gun had several disadvantages. The tolerance required between the plates, in order to allow the caulk tube to be loaded in the caulk gun, allowed an undesirable sliding back-and-forth of the caulk tube within the gun. Additionally, because of the distance between the front plate and back plate, only caulk tubes of a pre-determined size would fit in the caulk gun and not larger caulk tubes which hold more caulk. Furthermore, because the consumer market for caulk guns is very competitive, it is desirable to eliminate unnecessary materials, and their associated costs, in order to provide a more competitive product. The back plate, front plate, and intermediate frame structure are, in light of the present invention, unnecessary material and therefore add unnecessary expense to the caulk gun. And, smaller guns, i.e., not having a barrel or frame, would be more portable and more easily stored when not in use.

SUMMARY OF THE INVENTION

The present invention solves the above-noted deficiencies by providing a dripless caulk gun that is inexpensive to make and which is reliable even under heavy use. In addition, the present invention provides a tube-engaging receptacle that is fixedly attached to a handle of the caulk gun to fixedly but reasonably engage an end of a caulk tube thereby eliminating the need for front plates and the intermediate frame noted in the prior art examples above. The tube-engaging receptacle of the present invention is particularly well suited for caulk guns incorporating the dripless feature of the present invention.

A preferred embodiment of the present invention comprises a modified biased-spring drive mechanism caulk gun having a flexible gasket mounted onto an end of the plunger. In general, the gasket is sized slightly larger than an inside diameter of a caulk tube opening so that as the gasket enters the caulk tube, it forms an atmospheric seal with the inside surface. The trigger moves the plunger forward into the caulk tube for dispensing caulk. When the plunger is pressing against the drive plate in the caulk tube, the gasket will have formed a seal with an inside surface of the drive plate. Pressure on the trigger will cause pressure of the plunger on the drive plate in the caulk tube so that dispensing of caulk occurs. When the trigger is released, the biased-spring drive mechanism will exert a backward force on the plunger so as to try to move the plunger in the direction away from the caulk tube's drive plate. As the plunger attempts to move backward, the gasket seals against the inside of the drive plate or caulk tube thereby creating a partial vacuum within the space between the end of the plunger and the drive plate. That partial vacuum creates a pressure imbalance on opposite sides of the drive plate, causing it to move backward, thereby instantly releasing all built-up pressure within the caulk tube. The caulk thus instantly stops dispensing from the nozzle.

A preferred embodiment of the present invention includes a tube-engaging receptacle that is fixedly mounted to the caulk gun handle. The tube-engaging receptacle is fixedly attached to the handle and provided with a centrally located bore for receiving the plunger rod. Thereafter, a back end of a caulk tube is securely attached, or engaged, to the tube-engaging receptacle so that it is held firmly in place. With the present invention, it is not necessary to have a front plate or any intermediate frame or structure components connecting the front plate to the handle, such as the elongate stringers or open semi-tube of the prior art. Accordingly, a tube of almost any length may be used.

In a preferred embodiment, the tube-engaging receptacle is provided with a threaded interior surface, and a caulk tube's back end is provided with a threaded exterior surface. Accordingly, the caulk tube is threaded onto the tube-engaging receptacle and held firmly in place.

In another preferred embodiment of the tube-engaging receptacle it is provided with a threaded interior surface and a collar having an exterior threaded surface. A back end of the caulk tube is provided with a band-type projection. The banded end of the caulk tube is inserted into the tube-engaging receptacle, and the threaded collar is slid down the length of the caulk tube and threaded into the tube-engaging receptacle so as to impinge upon the caulk tube's band thereby holding it securely in place.

In another preferred embodiment of the present invention the tube-engaging receptacle is provided with a tapered, knurled surface and a collar, preferably having a tapered, knurled bore. The caulk tube is engaged to a receptacle by sliding walls of an open end of the caulk tube over the knurled surface and thereafter sliding the collar up over the caulk tube thereby pinching the walls of the caulk tube against the knurled surface. The orientation of the taper on the surface and the collar should be such that the tube is tightened against the surface as it is pushed away from the handle. Conversely, pushing the caulk tube towards the handle would loosen the pressure of the caulk tube against the knurled surface and permit the collar to be backed off so as to remove the caulk tube.

Another preferred embodiment of the present invention includes a receptacle having a plurality of threaded openings along a side wall having pointed thumb screws therein. The caulk tube is then inserted into the cup and the thumb screws are tightened so as to impinge upon the end of the caulk tube thereby holding it securely in the cup.

In another preferred embodiment of the present invention, there is provided a plunger adaptor having a flexible rim. The plunger adapter is provided with a U-shaped channel that fits over the end of prior art plunger pistons so as to provide a plunger having a flexible gasket at the end thereof to obtain the advantages of the present invention.

Various advantages and features of novelty which characterize the invention are particularized in the claims forming a part hereof. However, for a better understanding of the invention and its advantages, reference should be had to the drawings and to the accompanying description in which there is illustrated and described preferred embodiments of the invention.

DETAILED DESCRIPTION OF THE PREFERRED EMBODIMENTS

Figure 1:
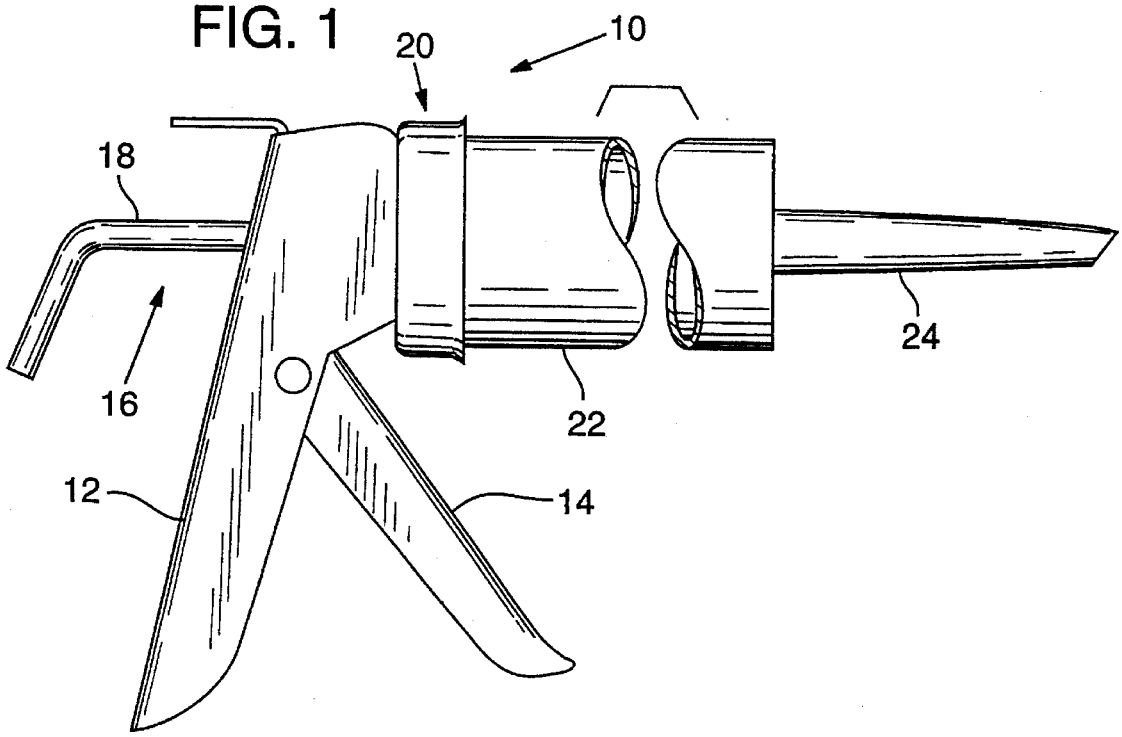
FIG. 1 is a side elevation view showing the preferred embodiment of a caulk gun of the present invention, having a caulk canister mounted therein.

FIG. 1 shows a general preferred embodiment of a caulk gun 10 having a handle 12 and pivotally attached trigger 14. The caulk gun 10 includes a plunger assembly 16 having a push rod 18. The caulk gun also includes a tube-engaging receptacle 20 that is securely mounted to the handle 12. Engaged with the receptacle 20 is a caulk tube 22 having a nozzle 24. Various embodiments of the dripless plunger mechanism 16 and the tube engaging receptacle will be described below with reference to FIGS. 2–7.

Figure 2:
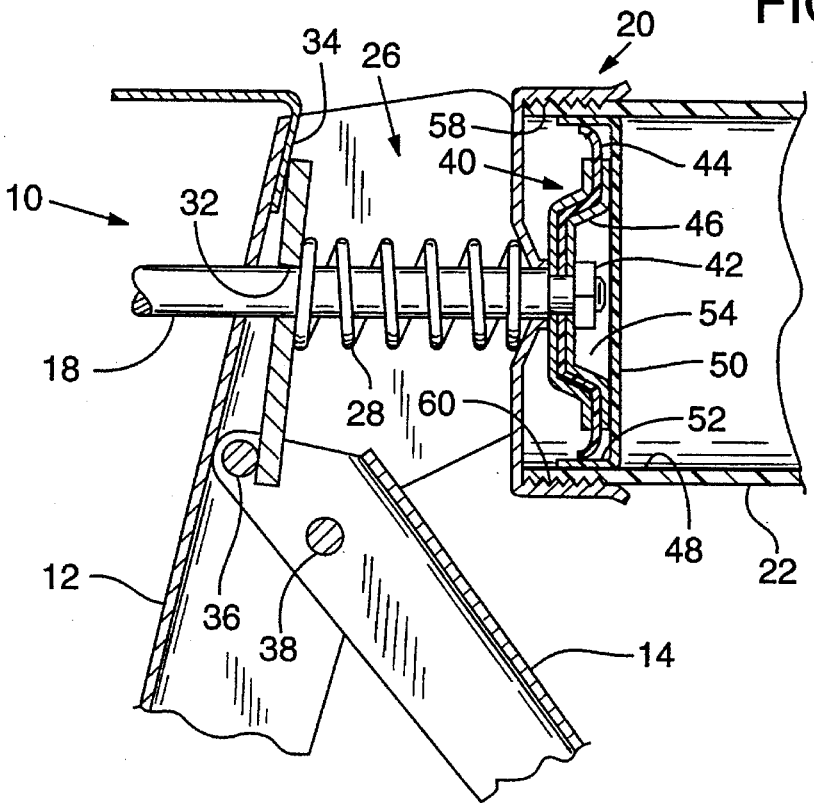
FIG. 2 is a partial cross-sectional view showing a drive mechanism and a preferred embodiment of a plunger and tube-engaging receptacle of the present invention.

FIG. 2 shows a preferred embodiment of the caulk gun 10 which is cut away to reveal a drive mechanism 26 for moving the push rod 18. The drive mechanism 26 includes a biasing spring 28 and a jam plate 30 having a hole 32 for receiving the rod 18. The jam plate 30 is disposed about the rod 18 and rests against an inside surface 34 of the handle 12 and a drive pin 36 that is attached to the trigger 14. The biasing spring 28 urges the jam plate 30 away from the tube-engaging receptacle 20 so that it is pressed against the driving pin 36 and the inside surface 34 of handle 12.

The bias-spring drive mechanism 26 works as follows: trigger 14 is operated by moving it in the direction toward the handle 12, pivoting it about a pivot pin 38 so that the drive pin 36 moves the lower edge of the jam plate 30 forward, toward the tube-engaging receptacle 20. This causes the jam plate to cant so that it jams on the rod 18 so that as the trigger 14 is moved further in the direction of the handle 12, the jam plate and rod move together. When the trigger 14 is released it moves away from the handle 12 under the urging of the bias spring 28 and the jam plate 30 and rod 18 move backward, together, away from the tube-engaging receptacle 20. When the trigger 14 is fully released, the jam plate 30 again rests against the inside surface 34 of the handle 12 and the drive pin 36. Also, when the trigger is fully released there is no resistance on the rod 18 and it slides freely through the handle 12, jam plate 30, bias spring 28, and tube-engaging receptacle 20.

The plunger assembly 16 also includes dripless piston 40 that is fixedly attached to rod 18 such as by nut 42. A preferred embodiment of the piston 40 includes a flexible gasket 44 mounted between two rigid plates 46. The plates 46 and gasket 44 are disc-shaped, having centrally located holes (not numbered) for mounting onto the rod 18. Preferably, the discs 46 are substantially rigid members such as pressed steel or other suitable metal. The gasket 44 is preferably of a flexible, resilient matter, such as rubber-dipped fabric or a light, rubber-backed canvas. The plates 46 and gasket 44 are sized so that the gasket 44 extends radially outward past the plates 46, thereby forming a flexible, circumferential rim of the piston 40. Furthermore, the gasket 44 must be sized so that its diameter is slightly larger than an inside diameter of the caulk tube 22, so as to form an atmospheric seal with an inside surface 48 of the caulk tube 22. The plates 46 must have a diameter that is smaller than the caulk tube's inside diameter.

As described above, operation of the trigger 14 in the direction towards the handle 12 moves the plunger assembly toward the tube-engaging receptacle 20 eventually causing the piston 40 to abut a push-plate 50 that is slidably mounted inside the caulk tube 22 and sealingly engaging the interior surface 48. As is well known in the art, it is pressure against the push-plate 50 that increases pressure within the caulk-filled interior of the caulk tube 22 thereby forcing caulk out through the nozzle 24. Thus, operation of the handle 14 pushes the rod 18 and piston 40 against the push-plate 50, thereby dispensing caulk.

As the piston 40 engages the push-plate 50, the gasket 44 engages a flange 52 of the push-plate 50, thereby creating an atmospheric seal with the flange and trapping a portion of air in a volume 54 between the piston 40 and push-plate 50. However, there is an insubstantial buildup of air pressure in volume 54 because the air is able to escape past the flange 44 by virtue of its configuration, much as the air is able to flow past a flapper valve in one direction.

Upon release of the trigger 14, the bias spring 28 urges the jam plate 30 back towards the handle 12. Because the jam plate 30 is still canted on the rod 18, the rod is moved back with the jam plate so that the piston 40 moves away from the push-plate 50 thereby creating a partial vacuum in volume 54 by virtue of the seal between the gasket 44 and flange 52 of the push-plate 50. And, because nature abhors a vacuum, the push-plate 50 is urged backwards, in the direction of the handle 12, thereby relieving any pressure built up within the caulk-filled portion of the caulk tube 22. As soon as the pressure in the caulk-filled portion is relieved, the caulk immediately ceases being dispensed through the nozzle 24. As the trigger 14 is further released, caulk is drawn back into the nozzle 24.

The tube-engaging receptacle 20 is shown in a preferred embodiment in FIG. 2. The receptacle 20 includes cup 56 having threads 58 on an interior surface thereof. A caulk tube 22 is attached to the tube engagement receptacle 20 by means of threads 60 on an exterior surface of the tube 22. Thus, the threads 58 on cup 56 comprise a tube engagement device and the threads 60 on the caulk tube 22 comprise a receptacle-engagement device.

The threads 60 may be cut directly in the tube 22, and may be reinforced for additional radial stiffness. Alternatively, the threads 60 may be cut in a reinforcing band applied to the outside surface of the tube 22. Alternatively, the tube-engaging receptacle may be provided with tap threads for cutting threads in the caulk tube.

Figure 3:
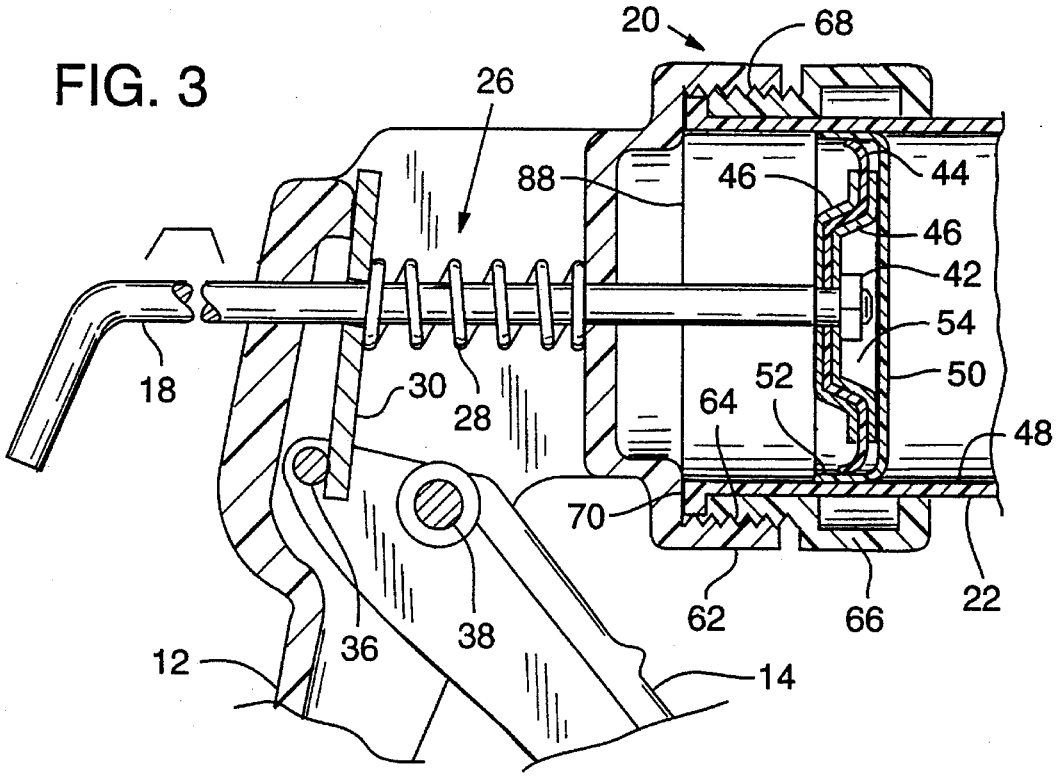
FIG. 3 is a cross-sectional view of a caulk gun showing a drive mechanism and an alternative preferred embodiment of a plunger and a tube-engaging receptacle of the present invention.

FIG. 3 depicts an alternative preferred embodiment of a tube-engaging receptacle of the present invention. In FIG. 3 the tube-engaging receptacle 20 comprises cup 62 having threads 64 along an interior surface thereof and a threaded locknut 66 having threads 68 along an exterior surface thereof. The tube 22 having a raised band 70 is attached to the tube-engaging receptacle 20 by inserting the banded end into the cup 62 and sliding the locknut 66 down the length of the tube 22 and threading it into the cup 62 thus pressing down upon the band 70 holding the tube 22 securely in place.

Figure 4:
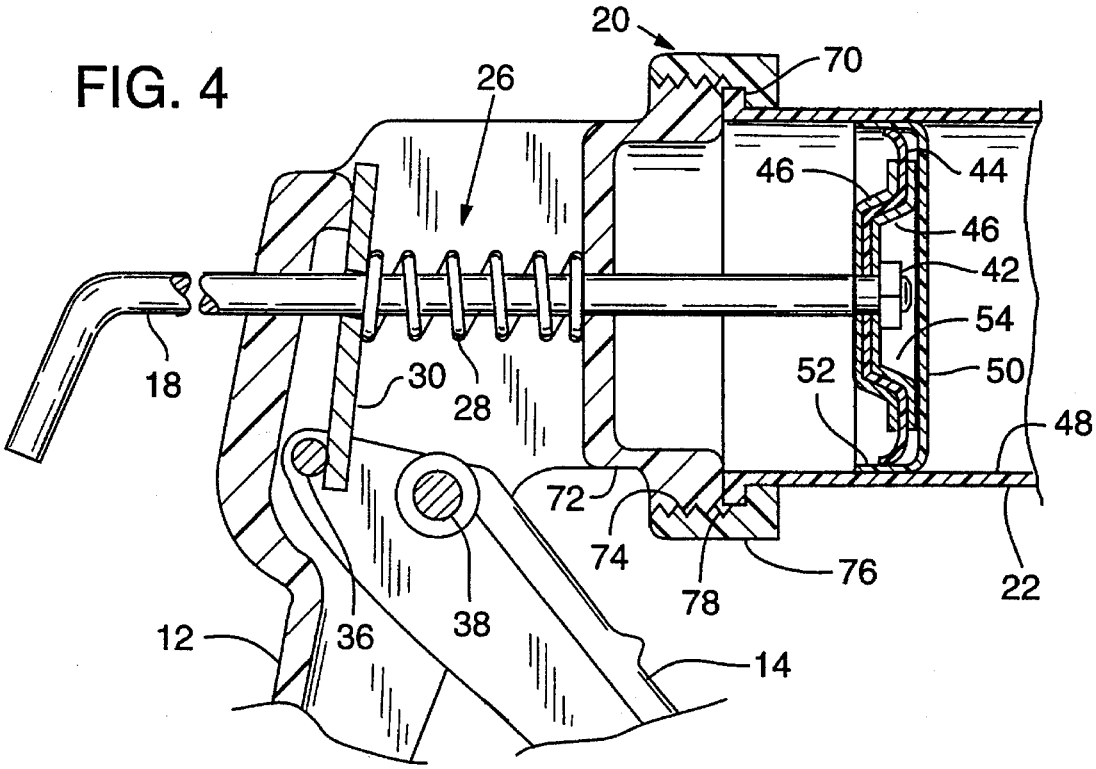
FIG. 4 is a cross-sectional view showing a drive mechanism of a caulk gun and an alternative preferred embodiment of a plunger and a tube-engaging receptacle of the present invention.

FIG. 4 depicts a further preferred embodiment of the tube receiving receptacle 20 of the present invention. In this embodiment, the tube-engaging receptacle 20 includes cup 72 having exterior threads 74 on an exterior surface thereof. A mating locknut 76 includes threads 78 along an interior surface. The caulk tube 22 is provided with a band 70 as described in connection with the embodiment of FIG. 3. The tube 22 is held securely by placing the band 70 against a portion of the cup 72 and thereafter sliding the locknut 76 down the tube so that it may threadingly engage the cup 72 thereby holding the tube 22 securely in place.

Figure 5:
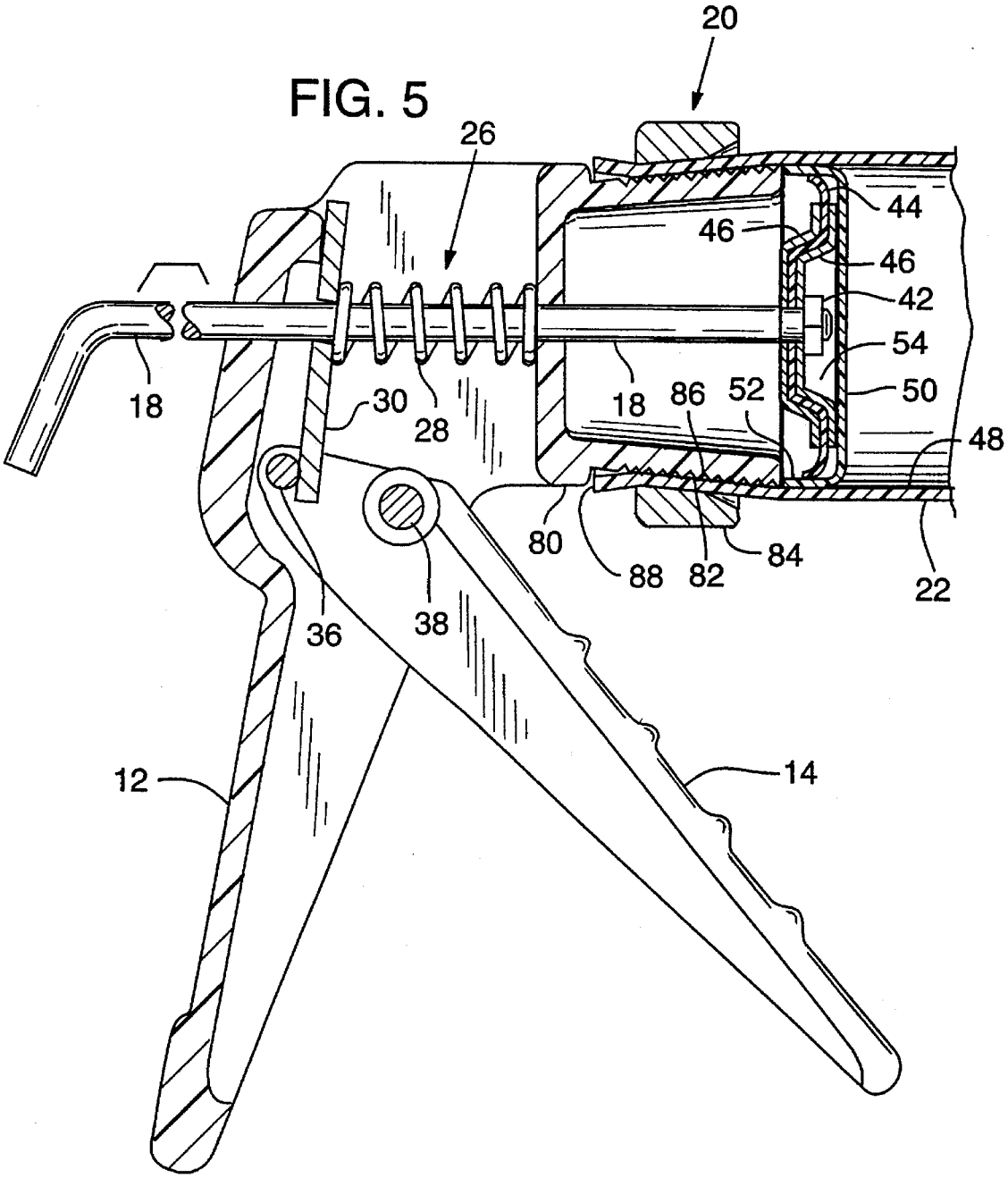
FIG. 5 is a cross-sectional view showing a drive mechanism of a caulk gun having a preferred embodiment of a plunger and a tube-engaging receptacle of the present invention.

A further alternative of the preferred embodiment is shown in FIG. 5, wherein the tube-engaging receptacle comprises a cup 80 having a tapered, knurled surface 82 and a collar 84 having interior tapered bore 86. To connect the caulk tube 22 to the tube-engaging receptacle 20 of this embodiment, the tube must have sufficient distance between an open end 88 and the push-plate 50 to allow walls of the tube 22 to fit down over the tapered surface 82 of cup 80. The tube 22 is engaged with the receptacle 20 by positioning the open end 88 at the top of cup 80 while the collar 84 is positioned loosely around the tapered surface 82. Thereafter, the tube 22 is pushed down over the cup 80 so it slides down along the inclined surface 82 and further sliding between the surface 82 and the collar 84. Collar 84 is then pulled up along the incline of surface 82 entrapping the tube 22 between the bore 86 of collar 84 and the surface 82 of cup 80.

Figure 6:
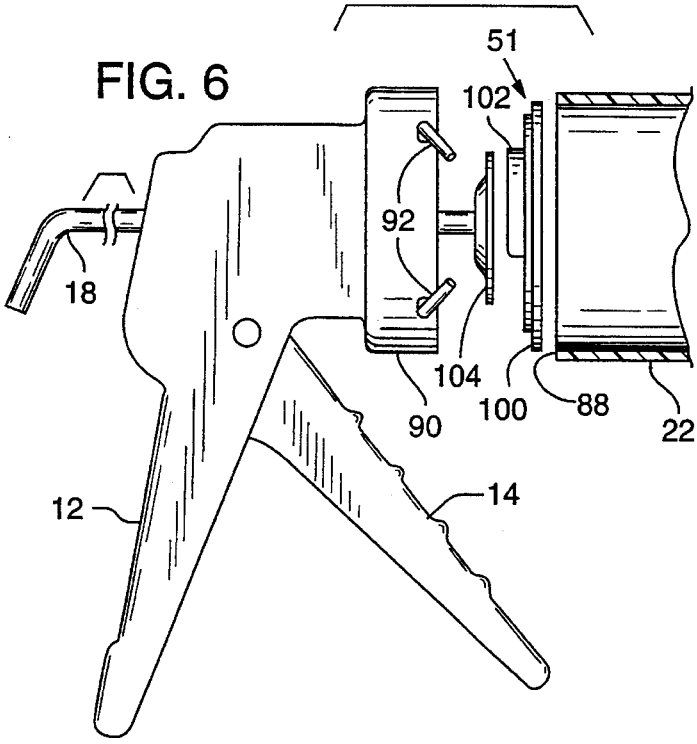
FIG. 6 is a side elevational view of a caulk gun handle and trigger mechanism having a preferred embodiment of a tube-engaging receptacle and plunger of the present invention.
Figure 7:
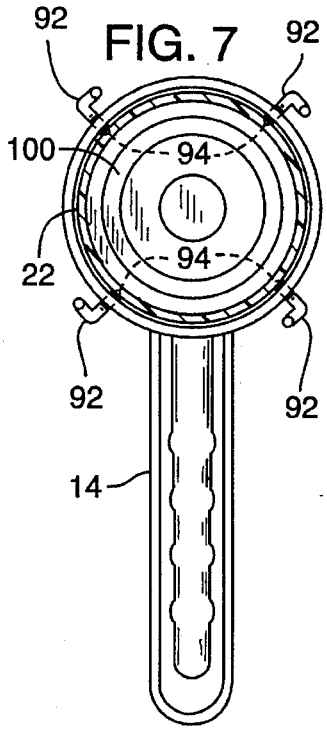
FIG. 7 is an end elevational view of the caulk gun of FIG. 6.

A further embodiment of the tube engaging receptacle 20 of the present invention is shown in FIGS. 6 and 7. In this embodiment, the receptacle 20 includes cup 90 having a plurality of threaded bores (not numbered) receiving an equal plurality of threaded thumbscrews 92. The thumbscrews 92 may be provided with sharp, piercing ends 94. A caulk tube 22 is engaged with receptacle 20 by fitting its open end 88 into the cup 90 and thereafter the thumbscrews 92 are turned to tighten the ends 94 onto the tube 22. Sufficient tightening will cause the ends 94 to pierce the walls of tube 22 thereby securely holding it in place.

Figure 8:
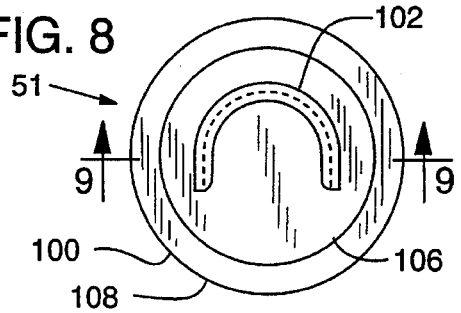
FIG. 8 is a front elevation view of a preferred embodiment of a plunger of the present invention.
Figure 9:
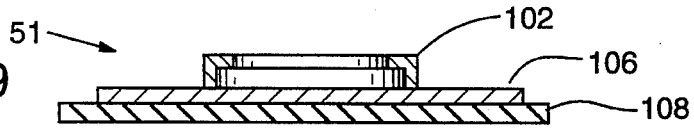
FIG. 9 is a cross-sectional view of a preferred embodiment of a plunger of the present invention taken along lines 9—9 of FIG. 8.

An alternative embodiment of the piston 50 is shown in FIGS. 8 and 9 and shown as part of the exploded view of FIG. 6. In this embodiment, the piston 50 is provided as a removable disc 100 having a U-shaped channel 102 that can receive a prior art piston 104 (as shown in FIG. 6). The disc 100 includes a substantially rigid backer plate 106 and a flexible gasket material 108 which is securely attached to the backer plate 106. The disc 100 may be operationally attached to a prior art piston 104 by merely sliding the channel 102 over the prior art piston. It is not necessary to secure the disc 100 to the piston 104 because the disc 100 will be kept in engagement with the piston 104 by its constraints within the tube 22. In this manner, prior art caulk guns may be easily converted to dripless guns incorporating the teachings and advantages of the present invention.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. A caulk gun for dispensing caulk from a cylindrical caulk tube having a rear drive plate, the gun comprising:

(a) a handle having a trigger mechanism pivotally connected to the handle;

(b) a plunger assembly including a plunger slidably connected to the handle, wherein operation of the trigger toward the handle drives a plunger in a forward direction and operation of the trigger away from the handle urges the plunger in a rearward direction; p1 (c) a piston connected to the plunger and having a flexible, circumferential rim for engaging the drive plate of the caulk tube, wherein the piston mechanically pushes against the drive plate when the plunger moves forwardly and the piston creates a pressure differential against the drive plate when the plunger moves rearwardly thus urging the drive plate rearwardly; and (d) a tube receiving receptacle coupled to the handle for receiving and fixedly engaging a portion of the elongate cylindrical tube and preventing movement of the cylindrical tube when the plunger pushes against the drive plate and the plunger urges the drive plate rearwardly.

2. The caulk gun of claim 1 wherein the tube receiving receptacle comprises a threaded bore.

3. The caulk gun of claim 1 wherein the tube receiving receptacle comprises a threaded bore and a threaded collar that couples with the threaded bore.

4. The caulk gun of claim 1 wherein the tube-receiving receptacle comprises an inclined surface and a collar.

5. The caulk gun of claim 1 wherein the tube-receiving receptacle comprises a cup-shaped receiver having tube-engaging restraints.

6. A caulk gun for dispensing caulk from an elongate cylindrical caulk tube having a drive plate, the caulk gun comprising:

(a) a handle having a pivotally attached trigger;

(b) an elongate rod slidably connected to the handle and in operable contact with the trigger wherein movement of the trigger in a first direction moves the rod in a first longitudinal direction and movement of the trigger in a second direction moves the rod in a second longitudinal direction;

(c) a piston connected to an end of the rod the piston having a flexible, circumferential rim that can form an atmospheric seal along an inner surface of the elongate, cylindrical tube, wherein movement of the rod in the first longitudinal direction pushes the piston against the drive plate in the tube thus urging the tube in the first longitudinal direction and movement of the rod in the second longitudinal direction creates an atmospheric differential urging the drive plate in the second longitudinal direction and urging the tube in the second longitudinal direction; and (d) a tube-engaging receptacle fixedly coupled to the handle for fixedly engaging the elongate, cylindrical tube so as to prevent longitudinal movement of the tube when the piston is pushing against the drive plate and when the piston creates the atmospheric differential that urges the drive plate in the second longitudinal direction.

7. The caulk gun of claim 6 wherein the plunger rod passes through the tube-engaging receptacle.

8. The caulk tube of claim 6 wherein the tube-engaging receptacle includes a threaded bore.

9. The caulk gun of claim 6 wherein the tube-engaging receptacle includes a threaded surface and threadingly engagable collar.

10. The caulk gun of claim 6 wherein the tube-engaging receptacle includes an inclined surface and a collar.

11. The caulk gun of claim 6 wherein the tube-engaging receptacle includes a cup-shaped receiver having a plurality of tube-engaging restraints.

12. A caulk gun system for dispensing caulk from a caulk tube having a moveable drive plate, the caulk gun system comprising:

(a) a handle having a pivotally mounted trigger;

(b) an elongate plunger rod slidably attached to the handle and operably attached to the trigger for longitudinal movement during operation of the trigger, and a piston coupled the rod, the piston including a tube coupler;

(c) the caulk tube having a receptacle-engagement device, and wherein the piston tube coupler engages the movable drive plate located in the tube so as to move the drive plate in first and second opposed directions; and (d) a tube-engagement receptacle fixedly connected to the handle and including a tube-engagement device that fixedly connects to the receptacle-engagement device on the tube so as to fix the position of the tube relative to the handle when the rod and piston engage the tube drive plate so as to urge the tube in the first and second opposed directions.

13. The caulk gun system of claim 12 wherein the receptacle-engagement device is a helical thread on the tube.

14. The caulk gun system of claim 12 wherein the receptacle-engagement device is band on the tube.

15. The caulk gun system of claim 12 wherein the receptacle-engagement device is a wall defining an opening.

16. The caulk gun system of claim 12 wherein the tube-engagement device is a helical thread.

17. The caulk gun system of claim 12 wherein the tube-engagement device is helical thread and a threaded collar.

18. The caulk gun system of claim 12 wherein the tube-engagement device is tapered surface and a collar.

19. A caulk gun for dispensing caulk from a caulk tube having a drive plate therein, the caulk gun comprising:

(a) a handle having an operable trigger;

(b) a plunger for pushing the drive plate of the caulk tube forwardly to expel caulk from a forward end of the tube and for urging the drive plate rearwardly to cease expelling caulk from the tube, the plunger being mounted on and operable through actuation of the trigger; and (c) a tube receiver fixed to the handle for receiving and gripping a portion of a caulk tube; such that actuation of the handle moves the plunger forwardly relative to the receiver and against the drive plate within the caulk tube to expel caulk from the forward end as the receiver grips the tube.

20. The caulk gun of claim 19 wherein the receiver includes threads on a surface of the receiver.

21. The caulk gun of claim 19 wherein the receiver includes threads and a locknut.

22. The caulk gun of claim 19 wherein the receiver includes a tapered surface on a pinch collar.

* * * * *